US007296515B1

(12) United States Patent
Chung

(10) Patent No.: US 7,296,515 B1
(45) Date of Patent: Nov. 20, 2007

(54) HAND STAMP WITH HOUSING HAVING ARCUATE SLOT AND STAMP CARRIER MOVABLE WITHIN SLOT

(75) Inventor: Chanseol Chung, Chagrin Falls, OH (US)

(73) Assignee: IDG, LLC, Cookeville, TN (US)

( * ) Notice: Subject to any disclaimer, the term of this patent is extended or adjusted under 35 U.S.C. 154(b) by 0 days.

(21) Appl. No.: 11/621,084

(22) Filed: Jan. 8, 2007

(51) Int. Cl.
*B41K 1/04* (2006.01)

(52) U.S. Cl. ..... 101/109; 101/327; 101/405

(58) Field of Classification Search ..... 101/327, 101/103, 106, 109, 110, 405, 406, 334, 333
See application file for complete search history.

(56) References Cited

U.S. PATENT DOCUMENTS

| | | | | |
|---|---|---|---|---|
| 388,437 | A * | 8/1888 | Norrington | 101/109 |
| 566,525 | A * | 8/1896 | Mitts | 101/103 |
| 2,784,668 | A * | 3/1957 | Poje | 101/109 |
| 3,714,894 | A * | 2/1973 | Robinson | 101/389.1 |
| D293,921 | S | 1/1988 | Harris | |
| 4,927,695 | A | 5/1990 | Ooms et al. | |
| 4,939,990 | A * | 7/1990 | Inaguma et al. | 101/109 |
| D322,984 | S | 1/1992 | Mehaffey et al. | |
| D324,396 | S | 3/1992 | Carlsson | |
| 5,105,738 | A | 4/1992 | Mehaffey | |
| D326,276 | S | 5/1992 | Mehaffey et al. | |
| 6,840,172 | B2 * | 1/2005 | Toyama | 101/405 |
| D554,523 | | 6/2007 | Bain et al. | |

OTHER PUBLICATIONS

U.S. Stamp & Sign:—Products, 1 page, http://www.usstamp.com/products-stamps.asp (at least prior to Oct. 12, 2006).

* cited by examiner

*Primary Examiner*—Leslie J. Evanisko
(74) *Attorney, Agent, or Firm*—Baker, Donelson, Bearman, Caldwell & Berkowitz, PC

(57) ABSTRACT

A stamp housing that defines an interior channel and a window, with a carrier received within the channel and movable from a first position to a second position, and a stamp body attached to the carrier and configured with a stamp image that receives an ink for transferring the stamp image to an article upon pressing application against the article with the carrier in the second position aligning the stamp image with the window of the housing, with the first position enclosing the stamp image remotely within the housing and non-aligned with the window.

38 Claims, 5 Drawing Sheets

HAND STAMP WITH HOUSING HAVING ARCUATE SLOT AND STAMP CARRIER MOVABLE WITHIN SLOT

TECHNICAL FIELD

The present invention relates to stamp devices for marking documents. More particularly, the present invention relates to self-contained hand-stamping devices movable from a closed position to an open position for stamping.

BACKGROUND

Documents frequently are marked with notational statements before placing in files, enclosing with correspondence, or using the document. Common notational statements include "COPY", "FAX", "FILE", "PAID" and other such conventional office phrases for marking documents. In addition, the notational statement can be custom for a particular office; for example, the notational statement may be a set of initials of persons in a particular group for a routing list.

The notational statements are conventionally applied using a reproducible stamp. The stamps conventionally include a holder and a stamp die that attaches to the holder. The stamp die includes a reverse image of the notational statement to be marked on the document. The reverse image of the notational statement often is formed in relief in a molded rubber sheet. Inked pads are used for applying an ink coating to the notational statement, which is then pressed against the document to transfer the ink and thus an image of the notational statement. Stamps widely used today however feature stamp dies or marking structures that include pre-inked microporous thermoplastic resin layers and absorbent backing layers. The microporous layer includes the stamp relief of the notational statement to be stamped. The ink communicates through the microporous layer to provide an ink coating on the notational statement for application to a document.

While such stamps are successful in marking documents, there are drawbacks to such devices. Some stamps use projecting knobs for gripping by hand during the stamping process. These knob-type stamps however are awkward to hold. Other stamps have detachable covers over the stamp die. These covers tend to become misplaced leading to die exposure and accidental marking.

Accordingly, there is a need in the art for a self-contained hand-stamping device readily movable from a closed position to an open position for stamping. It is to such that the present invention is directed.

SUMMARY OF THE INVENTION

The present invention meets the need in the art by providing a hand stamp for selectively positioning a stamp image for marking articles, comprising a housing that defines an interior channel and a window with a carrier received within the channel and movable relative to the housing from a first position to a second position, and a stamp body attached to the carrier and configured with a stamp image configured for receiving a coating of an ink from a supply for communicating the stamp image to an article upon pressing application against the article with the carrier in the second position aligning the stamp image with the window of the housing, with the first position enclosing the stamp image remotely non-aligned with the window within the housing.

Objects, features, and advantages of the present invention will become readily apparent upon reading of the following detailed description in conjunction with the drawings and the appended claims.

DETAILED DESCRIPTION

Figure 1:
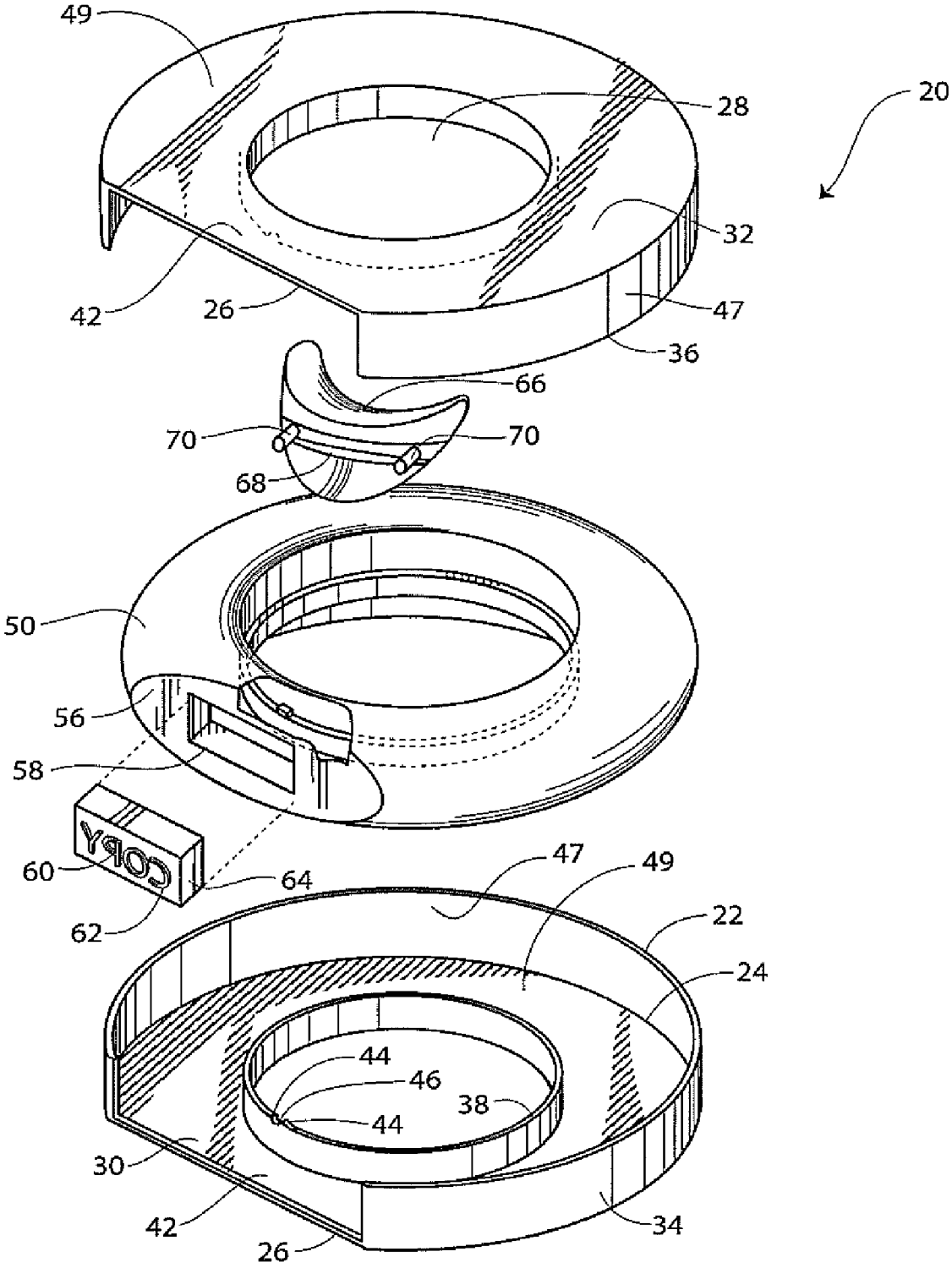
FIG. 1 illustrates in perspective exploded view a first embodiment of a stamp according to the present invention.

With reference to the drawings in which like reference numerals indicate like parts, FIG. 1 illustrates in perspective exploded view a first embodiment of a stamp 20 according to the present invention. The stamp 20 includes a housing 22 that defines an interior channel 24 and a window 26. The housing 22 assembles from two opposing shells 30, 32 that define matingly engageable edges 34, 36. The housing 22 defines an interior opening 28, which in the illustrated embodiment is circular. The opening 28 is likewise defined by interior portions of the shells 30, 32 having edges 38, 40. The edges 38, 40 are spaced-apart when the shells 30, 32 are engaged to define a slot 33. Opposing portions 42 of the edges 38, 40 each define spaced projections 44 and a intermediate recess 46. The projections 44 and the recess 46 cooperatively define a detent, for a purpose discussed below. In the illustrated embodiment, the housing 22 is substantially disc shaped with an arcuate perimeter sidewall 47 and opposing substantially planar sides 49.

The channel 24 receives a carrier 50. The carrier 50, as discussed below, is moveable within the channel 24 relative to the housing 22 from a first position to a second position. The carrier 50 includes an interior guide or flange 52. The guide flange 52 is received in the slot 33 defined by the edges 38, 40. Opposing projections 54 extend from the guide flange 52. The projections 54 bearingly pass over the respective projections 44 and are received in the respective recesses 46 to align the carrier 50 relative to the window 26 for operating the stamp.

The carrier 50 includes at least one planar surface 56 that defines a cavity 58 for receiving a conventional stamp die 60. In the illustrated embodiment, the stamp die 60 is a pre-inked stamp pad having an image layer 62 and an ink absorbent layer 64. The image layer 62 defines a relief of a notational statement in a conventional microporous inkretaining thermoplastic resin pad. The ink absorbent layer 64 includes a supply of ink. The ink communicates through the image layer 62 for stamping. The stamp 20 can also gainfully use conventional rubber stamp pads that use separate ink pads for inking the relief to be stamped.

A guide member 66 engages the guide flange 52. The guide member 66 includes a projecting block 68 and opposing spaced-apart pins 70. The block 68 connects by being received in a slot or opening in the guide flange 52 and the pins 70 engage holes in the carrier 50.

Figure 2:
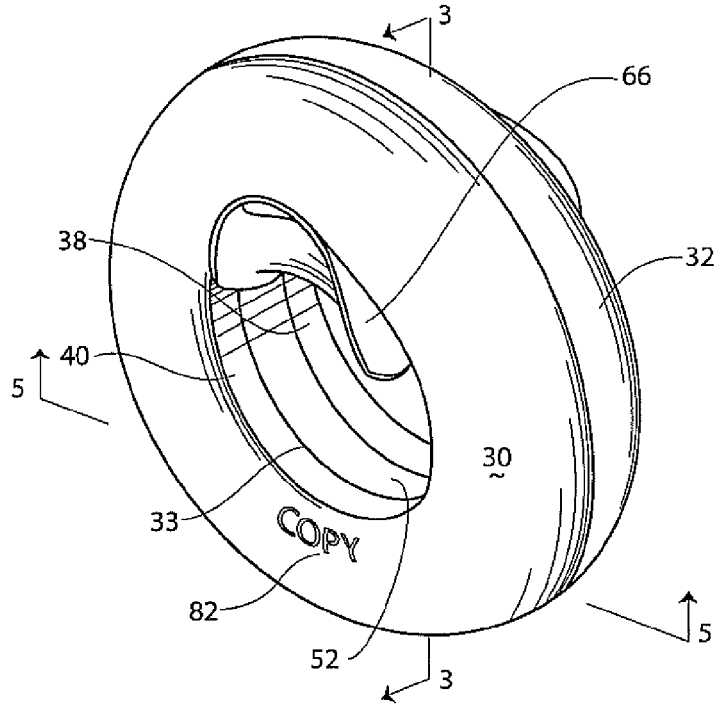
FIG. 2 illustrates in perspective view a second embodiment of a stamp according to the present invention.

FIG. 2 illustrates the stamp 20 in perspective view. The housing 22 in this illustrated embodiment comprises a torus or doughnut-shaped housing with a planar window 26 or opening defined by a chord plane extending across a portion of the housing 22. The carrier 50 likewise defines a toric body received in the housing 22. The exterior surface of the housing 22 selectively includes an indicia 82 representing the stamp image. For example, the indicia 82 can be the text "copy" for a stamp image to mark the word "copy" on an article. In an alternate embodiment, the housing 22 has opposing side walls that provide a suitable substantially planar surface for printing graphics, labeling, or other text information.

Figure 3:
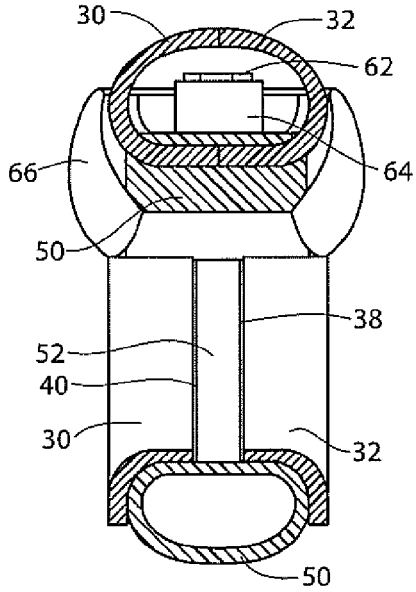
FIG. 3 illustrates in sectional view the stamp illustrated in FIG. 2 taken along line 3-3.

FIG. 3 illustrates in perspective sectional view the stamp 20 illustrated in FIGS. 1 and 2, taken along line 3-3 of FIG. 2. The mating shells 30, 32 define the slot 33 between the opposing edges 38, 40 on an interior of the housing 22. The guide flange 52 of the carrier 50 travels in the slot 33. The guide member 66 attached to the guide flange 52 facilitates moving the carrier 50 relative to the housing 22 from the first position with the stamp pad 60 received enclosingly within the housing and not aligned with the window 26 and the second position with the stamp pad 60 aligned within the window 26 for operation of the stamp.

Figure 4:
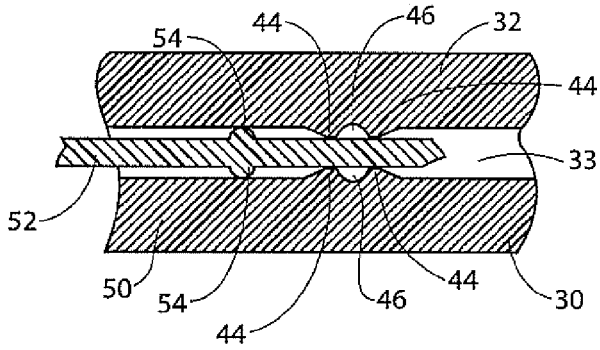
FIG. 4 illustrates in detailed sectional view a detent feature of the housing of the stamp for holding a stamp die in position for application of a stamp image to an article.

FIG. 4 illustrates in detailed sectional view the projections 44 and the recesses 46 on the edges 38, 40 that receive the projections 54 of the guide flange 52, as a detent for holding the carrier 50 in the second position with the stamp pad 60 aligned in the window 26 of the housing 22. A similar detent structure can be included in an opposing portion of the housing for holding the stamp pad 60 in the first position for storage.

Figure 5:
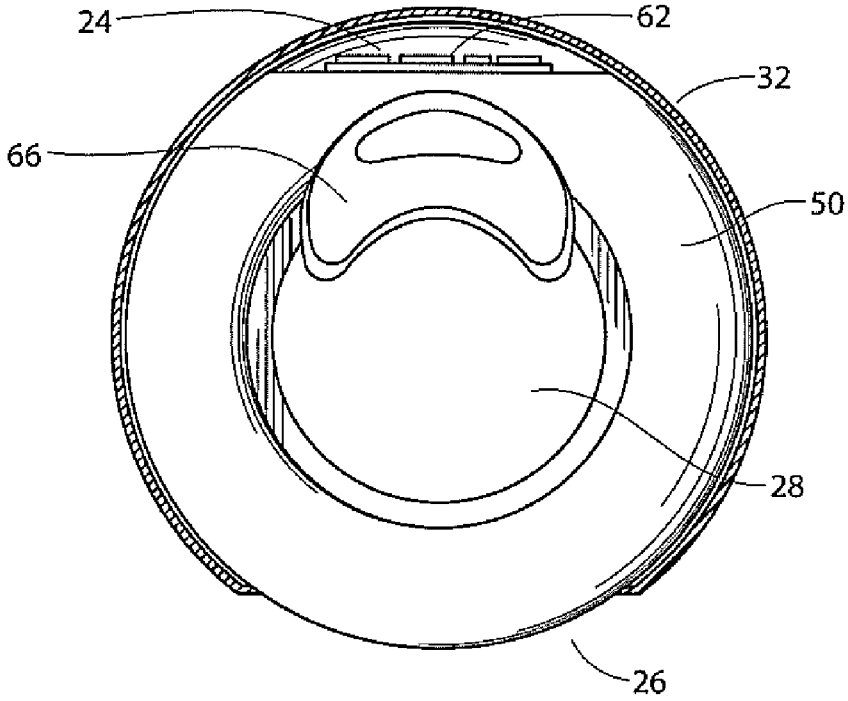
FIG. 5 illustrates in sectional view the stamp illustrated in FIG. 2 taken along line 5-5.

FIG. 5 illustrates the toric housing 22 of the stamp 20 in sectional view taken along line 5-5 of FIG. 2 with the carrier 50 disposed for a travel in the channel 24. The guide member 66 attaches to the guide flange 52 with the block 68 and the pins 70. With reference to FIG. 3 and FIG. 5, the guide member 66 in the illustrated embodiment is a saddle-shaped member having opposing sides that extend arcuately adjacent the exterior of the housing 22.

Figure 6:
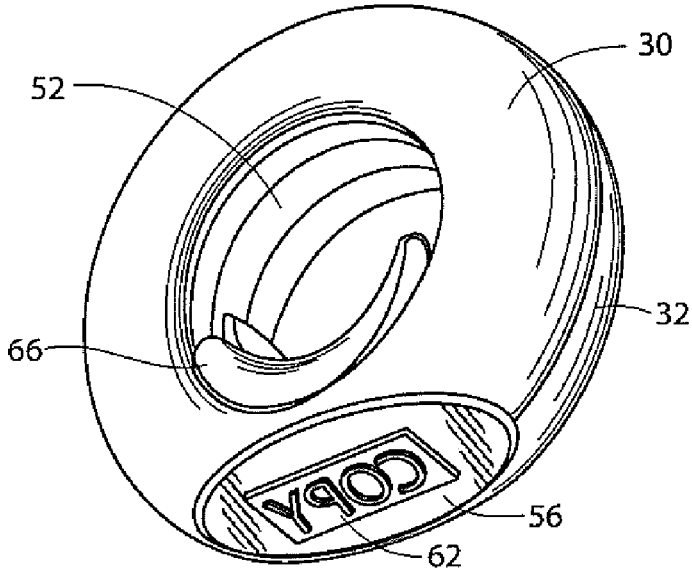
FIG. 6 illustrates in perspective view the stamp illustrated in FIG. 2 in an operative position for marking a stamp image on an article.

FIG. 6 illustrates the stamp 20 with the guide member 66 moved to the second position with the stamp pad 60 aligned in the window 26 for marking operation. In this position, the detent is operative. With reference to FIG. 4, the projections 54 are received in the recesses 46 between the aligned opposing projections 44 extending from the opposing edges 38, 40 of the shells 30, 32.

Figure 7:
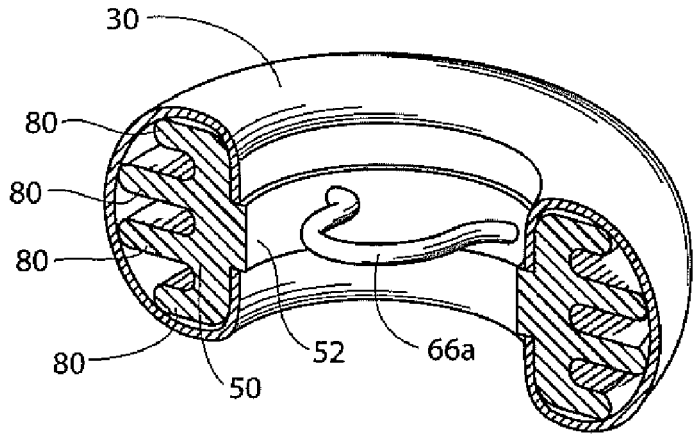
FIG. 7 illustrates in perspective view a second embodiment of the stamp according to the present invention.

FIG. 7 illustrates in perspective sectional view a second embodiment of the stamp 20. In this embodiment, the carrier 50 includes spaced-apart rails 80 that project outwardly through the cavity 24 to short of the interior surface of the shells 30, 32. The rails 80 guide the rotation of the carrier 50 in the channel 24 of the housing. FIG. 7 further illustrates the guide member 66 in an alternate embodiment as a loop 66*a* extending from the flange 52 inwardly of the opening 28.

Figure 8:
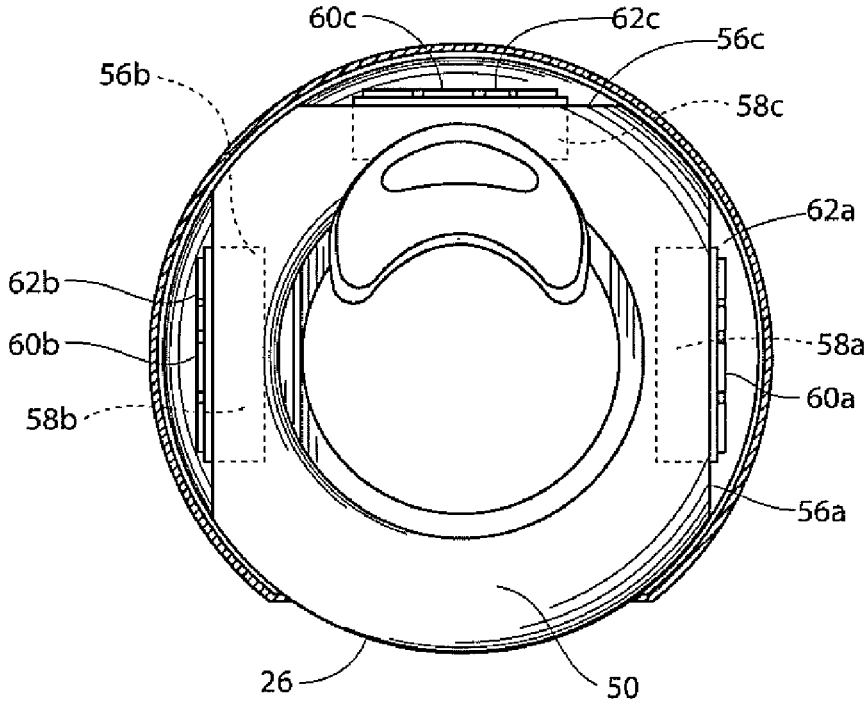
FIG. 8 illustrates in sectional view a third embodiment of a stamp according to the present invention.
Figure 9:
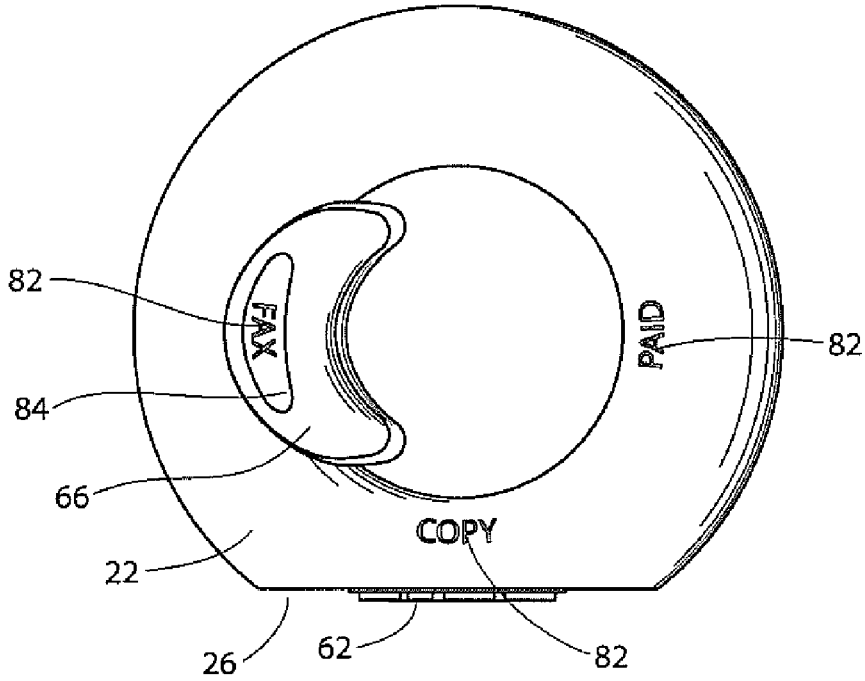
FIG. 9 illustrates in side view the stamp illustrated in FIG. 8.
Figure 10:
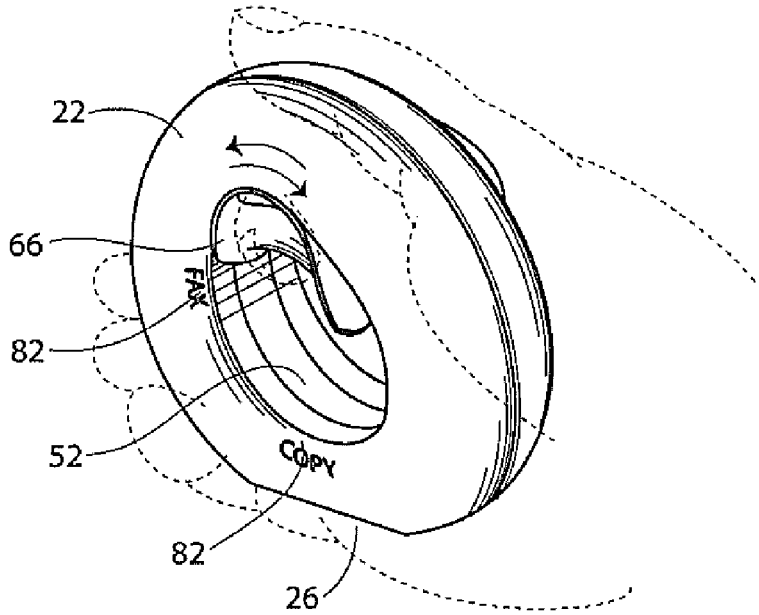
FIG. 10 illustrates in side perspective view the stamp in an operative position for selecting the stamp image to align in a window of the stamp housing for use as a stamp.

FIG. 8 illustrates in sectional view a third embodiment of the stamp 20. In this embodiment, the carrier 50 defines three planar surfaces 56 (denoted 56*a*, 56*b*, and 56*c*) each having a cavity 58 (denoted 58*a*, 58*b* and 58*c*) for receiving a stamp pad 60 (denoted 60*a*, 60*h* and 60*c*) each having a respective image layer 62 (denoted 62*a*, 62*b*, and 62*c*). As illustrated in FIGS. 2, 9, and 10, the exterior wall of the housing 22 includes an indicia 82, such as text or graphic, of the stamp on the image film 62. Rotation of the guide member 66 into alignment with one of the respective indicia 82 indicates that the respective stamp pad 60 is aligned with the window 26. In this embodiment, the edges 36, 38 include three sets of detent elements including the projections 44 and recess 46 for holding the selective stamp image in the window 26. The guide member 66 upon aligning with the indicia 82 provides a pointer indicating which of the stamp pads is positioned for marking articles. This embodiment also illustrates an opening 84 in the side walls of the guide member 66. The indicia 82 is viewable in the opening 84 upon alignment of the stamp pad 60 in the window 26. The planar walls 49 of the embodiment illustrated in FIG. 1 provides a surface for printing of labels or graphics.

The hand stamp 20 described above, and illustrated in several embodiments selectively operates to position the stamp image 62 carried by the stamp pad 60 within the window 26 of the housing 22. FIG. 10 illustrates in side perspective view the stamp 10 in an operative position for selecting the stamp image 62 to align in the window 26 of the stamp housing 22 for use as a stamp, with a hand of a user illustrated in phantom and the thumb positioned adjacent an exterior portion of the housing 22, the index finger extending through the opening 28 in alignment with the guide member 66, and the other fingers on an opposing exterior portion of the housing. With reference to FIGS. 2, 6, and 10, the housing 22 is picked up by hand, with the index finger positioned in the curved guide member 66 with the thumb bearing on an outer surface of the housing 22. The thumb is extended while in contact with the surface of the housing 22. This causes the housing 22 to rotate relative to the carrier 50 held by the index finger pressing against the guide member 66.

The thumb is released from contact with the surface of the housing 22 and retracted and with bending the tip of the thumb is brought into bearing contact with another portion of the housing 22. The thumb is extended again to rotate the housing 22 relative to the carrier 50. This action is repeated until the stamp pad 60 becomes aligned with the window 26 of the housing 22. The projections 54 of the guide flange 52 flexingly bypass the projections 44 of the detent. The projections 54 are received in the recess 46. This holds the carrier 50 with the selected stamp pad 60 aligned in the window 26. The housing 22 is then rotated so that the stamp pad 60 faces a document to be marked. The housing 22 is brought into contact with the document. The ink communicates from the ink pad 64 to the image film 62, and transfers to the document.

Upon completion of marking documents with the stamp 20, the thumb again is positioned on the housing 22 and extended to rotate the stamp pad 60 from alignment in the window 26 and inwardly enclosingly within the housing 22.

It is to be appreciated with respect to the embodiment illustrated in FIGS. 9 and 10 that movement of the housing 22 relative to the guide members 66 enables orienting the selected one of the stamp pad 60 in the window 26. When the guide member 66 aligns with the indices 78 on the sidewall of the housing 22, the associated stamp pad 60 is aligned with the opening 26 for operation.

The toric housing 22 with the enclosed toric carrier 50 facilitates the operation of the stamp 20, but is not a limiting feature, in that the housing may have various ornamental configurations. Further, the carrier 50 can be a movable belt disposed within the housing.

The foregoing specification describes the present invention that provides the hand-held housing that encloses the stamp member readily movable between the enclosed position and the exposed position for hand stamping. It is to be understood, however, that numerous changes and variations may be made in the construction of the converter within the spirit and scope of the present invention and that modifications and changes may be made therein without departing from the scope thereof as set forth in the appended claims.

What is claimed is:

1. A hand stamp for selectively positioning a stamp image for marking articles, comprising:

a housing that defines an interior channel, a window, and an arcuately extending slot defined by opposing edges in the housing and open to the interior channel;

a carrier received within the channel and movable relative to the housing from a first position to a second position with a portion traveling in the slot; and a stamp body attached to the carrier and configured with a stamp image for receiving a coating of ink from a supply to transfer to an article upon pressing application against the article with the carrier in the second position aligning the stamp image with the window of the housing and in the first position enclosing the stamp image remotely non-aligned with the window within the housing.

2. The hand stamp as recited in claim 1, wherein the housing defines the opposing edges of the slot in an interior wall.

3. The hand stamp as recited in claim 1, further comprising an interior member operatively engaged to the carrier for being contacted to move the carrier between the first position and the second position.

4. The hand stamp as recited in claim 1, wherein the housing defines a toric shell and the window defines a chord in plan view.

5. The hand stamp as recited in claim 4, wherein the slot is continuous in an interior surface of the toric shell.

6. The hand stamp as recited in claim 5, further comprising an interior member operatively engaged to the carrier for being contacted to move the carrier between the first position and the second position.

7. The hand stamp as recited in claim 6, further comprising an indicia representative of the stamp image fixed to the toric shell and the interior member engaged to the carrier so that the interior member aligns with the indicia when the carrier is in the second position with the stamp image in the window.

8. The hand stamp as recited in claim 4, wherein the carrier comprises a toric member having a planar chordic surface to which the stamp body attaches.

9. The hand stamp as recited in claim 8, wherein the toric member has three angularly spaced planar chordic surfaces with a stamp body attached to each, the toric member movable selectively to position each one of the stamp bodies within the window for stamping application.

10. The hand stamp as recited in claim 9, further comprising a plurality of indicia, each representative of one of the stamp images and fixed to the housing; and an indicator extending from the carrier that aligns with the indicia associated with the stamp image positioned in the window upon moving the carrier relative to the housing.

11. The hand stamp as recited in claim 10, wherein the indicator comprises a contactable body for moving the carrier relative to the housing.

12. The hand stamp as recited in claim 11, wherein the indicator comprises a saddle member.

13. The hand stamp as recited in claim 11, wherein the indicator comprises a loop member.

14. The hand stamp as recited in claim 1, wherein the channel further comprises a detent and the carrier further comprises a projecting lug, the lug engaging the detent when the stamp image is positioned within the window.

15. The hand stamp as recited in claim 1, wherein the stamp image is formed in a layer containing a supply of an ink that communicates to the stamp image for marking.

16. The hand stamp as recited in claim 1, wherein the housing is a toric body.

17. The hand stamp as recited in claim 16, wherein the carrier is a toric body.

18. The hand stamp as recited in claim 1, wherein the portion comprises a guide member extending from the carrier into the slot for guiding the movement of the carrier within the channel.

19. The hand stamp as recited in claim 1, wherein the housing comprises opposing shells that matingly connect and define the slot between opposing edges of the shells.

20. A hand stamp for selectively positioning a stamp image for marking articles, comprising:

a housing that has an arcuately extending guide slot defined by opposing edges in the housing and open to an interior thereof and an exterior window;

a carrier having at least one stamp body and received within the housing, the carrier movable relative to the housing from a first position to a second position guided by a guide member extending from the carrier and received in the guide slot for travel; and the stamp body comprising a stamp image for receiving a coating of an ink from a supply of ink for transferring to an article upon pressing application against the article with the carrier in the second position aligning the stamp image with the window of the housing and with the carrier in the first position the stamp image remotely non-aligned with the window and enclosed within the housing.

21. The hand stamp as recited in claim 20, wherein the carrier defines at least three stamp bodies.

22. The hand stamp as recited in claim 21, further comprising an indicia representative of each of the stamp images and fixed to the housing; and an indicator extending from the carrier that aligns with the indicia associated with the stamp image positioned in the window upon moving the carrier relative to the housing.

23. The hand stamp as recited in claim 22, wherein the indicator comprises a contactable body for moving the carrier relative to the housing.

24. The hand stamp as recited in claim 23, wherein the indicator comprises a saddle member.

25. The hand stamp as recited in claim 23, wherein the indicator comprises a loop member.

26. The hand stamp as recited in claim 20, wherein the housing further comprises a detent and the carrier further comprises a projecting lug, the lug engaging the detent when the stamp image is positioned within the window.

27. The hand stamp as recited in claim 20, wherein the stamp body further comprises an ink-absorbent layer for containing a supply of ink that communicates to the stamp image.

28. The hand stamp as recited in claim 20, wherein the carrier is a toric body.

29. The hand stamp as recited in claim 28, wherein the housing is a disc body.

30. The hand stamp as recited in claim 28, wherein the housing is a toric body.

31. A hand stamp for selectively positioning a stamp image for marking articles, comprising:

a toric housing that defines an interior channel and a window;

a carrier received within the channel and movable relative to the housing from a first position to a second position; and a stamp body attached to the carrier and configured with a stamp image for receiving a coating of ink from a supply to transfer to an article upon pressing application against the article with the carrier in the second position aligning the stamp image with the window of the housing, with the first position enclosing the stamp image remotely non-aligned with the window within the housing.

32. The hand stamp as recited in claim 31, further comprising a guide member operatively engaged to the carrier and extending through the slot for guiding the movement of the carrier within the channel.

33. The hand stamp as recited in claim 32, wherein the guide member comprises a saddle.

34. The hand stamp as recited in claim 32, wherein the guide member comprises a loop.

35. A hand stamp for selectively positioning a stamp image for marking articles, comprising:

a toric housing that defines a guide slot and an exterior window;

a carrier defining at least one stamp surface and received within the housing, the carrier movable relative to the housing guided by a guide member extending from the carrier and received in the guide slot for travel relative to the housing to position the stamp surface selectively in the window; and a stamp body attached to the stamp surface of the carrier, the stamp body comprising a stamp image for receiving a coating of an ink from a supply of ink for transferring to an article upon pressing application against the article with the carrier moved to position the stamp body exposed in the window.

36. The hand stamp as recited in claim 35, wherein the carrier is a toric body.

37. The hand stamp as recited in claim 35, wherein the carrier defines at least three stamp surfaces each with a stamp body.

38. The hand stamp as recited in claim 37, further comprising an indicia representative of each of the stamp images and fixed to the housing; and an indicator that aligns with the indicia associated with the stamp image positioned in the window upon moving the carrier relative to the housing.

* * * * *